US005498325A

United States Patent [19]

Nishimura et al.

[11] Patent Number: 5,498,325

[45] Date of Patent: Mar. 12, 1996

[54] METHOD OF ELECTROPLATING

[75] Inventors: Seiya Nishimura; Yoshihisa Maejima; Tokuyoshi Ohta, all of Shizuoka, Japan

[73] Assignee: Yamaha Corporation, Japan

[21] Appl. No.: 372,552

[22] Filed: Jan. 13, 1995

Related U.S. Application Data

[62] Division of Ser. No. 192,425, Feb. 7, 1994, Pat. No. 5,441, 620.

[30] Foreign Application Priority Data

Feb. 10, 1993 [JP] Japan ..... 5-23046

[51] Int. Cl.[6] ..... C25D 21/06; C25D 21/12

[52] U.S. Cl. ..... 205/96

[58] Field of Search ..... 205/96–97, 147; 204/99, 101

[56] References Cited

U.S. PATENT DOCUMENTS

| | | | |
|---|---|---|---|
| 3,200,055 | 8/1965 | Scacciati | 204/282 X |
| 4,328,076 | 5/1982 | Fisher et al. | 204/282 X |
| 4,455,209 | 6/1984 | Hermann | 204/282 X |
| 5,080,762 | 1/1992 | Ochiai et al. | 205/97 |
| 5,173,170 | 12/1992 | Brown et al. | 205/96 |

*Primary Examiner*—Donald R. Valentine
*Attorney, Agent, or Firm*—Ostrolenk, Faber, Gerb & Soffen

[57] ABSTRACT

An electroplating apparatus carries out an electroplating on a work by using an insoluble anode for keeping the electrolyte clean, and, thereafter, makes up ionized metal into the electrolyte by respectively connecting a soluble anode and the insoluble anode with a positive electrode and a negative electrode, thereby preventing an operator from the make-up work.

2 Claims, 4 Drawing Sheets

METHOD OF ELECTROPLATING

This is a division of application Ser. No. 08/192,425, filed Feb. 7, 1994, now U.S. Pat. 5,441,620.

FIELD OF THE INVENTION

This invention relates to an electroplating and, more particularly, to an electroplating apparatus and a method using the apparatus.

DESCRIPTION OF THE RELATED ART

A typical example of the electroplating apparatus is illustrated in FIG. 1 of the drawings, and comprises an electrolysis vessel 1 for electrolyte 2, a soluble anode 3 and an electric power source 4. The anode 3 is connected with a positive electrode 4*a* of the electric power source 5.

In the electroplating, a work 5 is dipped into the electrolyte 2, and is connected with a negative electrode 4*b* of the electric power source 4. While current is flowing through the electrolyte 2 between the anode 3 and the work 5, the following ionic reaction takes place at the anode 3.

$$M \rightarrow M^{+} + e^{-} \quad (1)$$

where M is the metal forming the anode 3. The metal ion $M^{+}$ is supplied from the anode 3 into the electrolyte 2, and the metal ion $M^{+}$ travels through the electrolyte 2 toward the work 5. The metal M is deposited on the work 5 as follows.

$$M^{+} + e^{-} \rightarrow M \quad (2)$$

Thus, the metal M is ionized at the anode 3, and the metal ion $M^{+}$ is deionized at the work 5. As a result, the ion concentration in the electrolyte 2 is theoretically constant.

On the other hand, if the soluble anode 3 is replaced with an insoluble anode, the following reaction takes place around the insoluble anode.

$$2OH^{-} \rightarrow H_2O + O_2/2 + 2e^{-} \quad (3)$$

The metal ion M in the electrolyte 2 is reacted with the anion at the work 5.

$$M^{+} + e^{-} \rightarrow M \quad (4)$$

Thus, the metal ion $M^{+}$ in the electrolyte 2 is consumed at the work 5 for the electroplating, and the insoluble anode does not supplement the metal ion $M^{+}$. As a result, the ion concentration of the electrolyte 2 is decreased with time, and an operator supplements the metal ion $^{+}$ to the electrolyte 2.

The electroplating apparatus with the soluble anode 3 encounters a problem in that the metal film deposited on the work 5 is not high in quality. This is because of the fact that sludge dissolves into the electrolyte 2 during the ionization at the anode 3, and the sludge is mixed into the deposited metal film. However, the operator does not have to supplement the metal ion $M^{+}$.

On the other hand, the electroplating apparatus with the insoluble anode encounters a problem in that it is necessary to periodically supplement the metal ion into the electrolyte 2. However, the deposited metal is higher in quality than that of the metal film deposited by using the soluble anode 3.

Thus, there is a trade-off between the soluble anode 3 and the insoluble anode, and the high quality is incompatible with the simple electroplating.

SUMMARY OF THE INVENTION

It is therefore an important object of the present invention to provide an electroplating apparatus which reconcile a high quality deposited metal film and a simple electroplating work.

It is another important object of the present invention to provide a method for the electroplating.

To accomplish the object, the present invention proposes to selectively use a soluble anode and an insoluble anode both dipped in electrolyte together with a work.

In accordance with one aspect of the present invention, there is provided an electroplating apparatus used for electroplating a substance on a work, comprising: a) an electrolysis vessel filled with an electrolyte; b) a soluble conductive member dipped in the electrolyte and containing the substance; c) an insoluble conductive member spaced apart from the soluble conductive member in the electrolyte; d) a cathode member retaining the work in the electrolyte in spacing relation to the insoluble conductive member; e) an electric power source having a positive electrode and a negative electrode; and f) a switching unit having a first input port connected with the positive electrode, a second input port connected with the negative electrode, a first output port connected with the insoluble conductive member, a second output port connected with the cathode member and a third output port connected with the soluble conductive member, and shifted between a first position and a second position, the switching unit connecting the first and second input ports with the first and second output ports in the first position and with the third and second output ports.

The apparatus may have a filter means provided in association with the soluble conductive member, and operative to filter off a sludge produced from the soluble conductive member during an ionization of the substance.

In accordance with another aspect of the present invention, there is provided a method of electroplating comprising the steps of: a) preparing an electrolysis vessel filled with an electrolyte containing an ionized substance, a soluble conductive member dipped in the electrolyte and containing a substance to be ionized, an insoluble conductive member spaced apart from the soluble conductive member in the electrolyte, and a cathode retaining a work in the electrolyte in spacing relation to the insoluble conductive member, b) causing current to flow between the soluble conductive member and the insoluble conductive member for depositing the substance on the insoluble conductive member; and c) causing current to flow between the insoluble conductive member and the work for depositing the substance on said work.

A filter means may be provided in association with the soluble conductive member for filtering off a sludge produced from the soluble conductive member during an ionization of the substance.

BRIEF DESCRIPTION OF THE DRAWINGS

The features and advantages of the electroplating apparatus and the method according to the present invention will be more clearly understood from the following description taken in conjunction with the accompanying drawings in which.

DESCRIPTION OF THE PREFERRED EMBODIMENTS

First Embodiment

Figure 1:
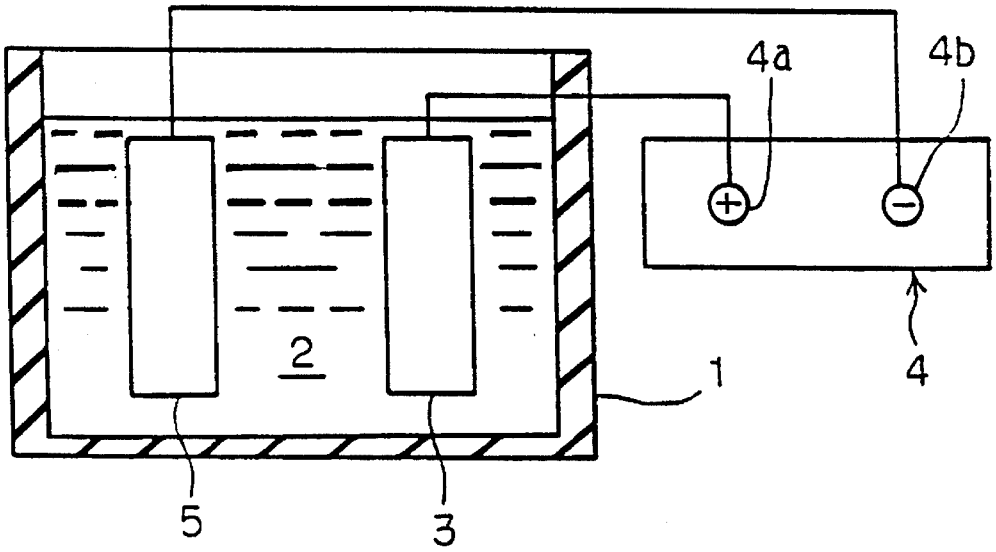
Fig·1 PRIOR ART
FIG. 1 is a cross sectional view showing the prior art electroplating apparatus.
Figure 2:
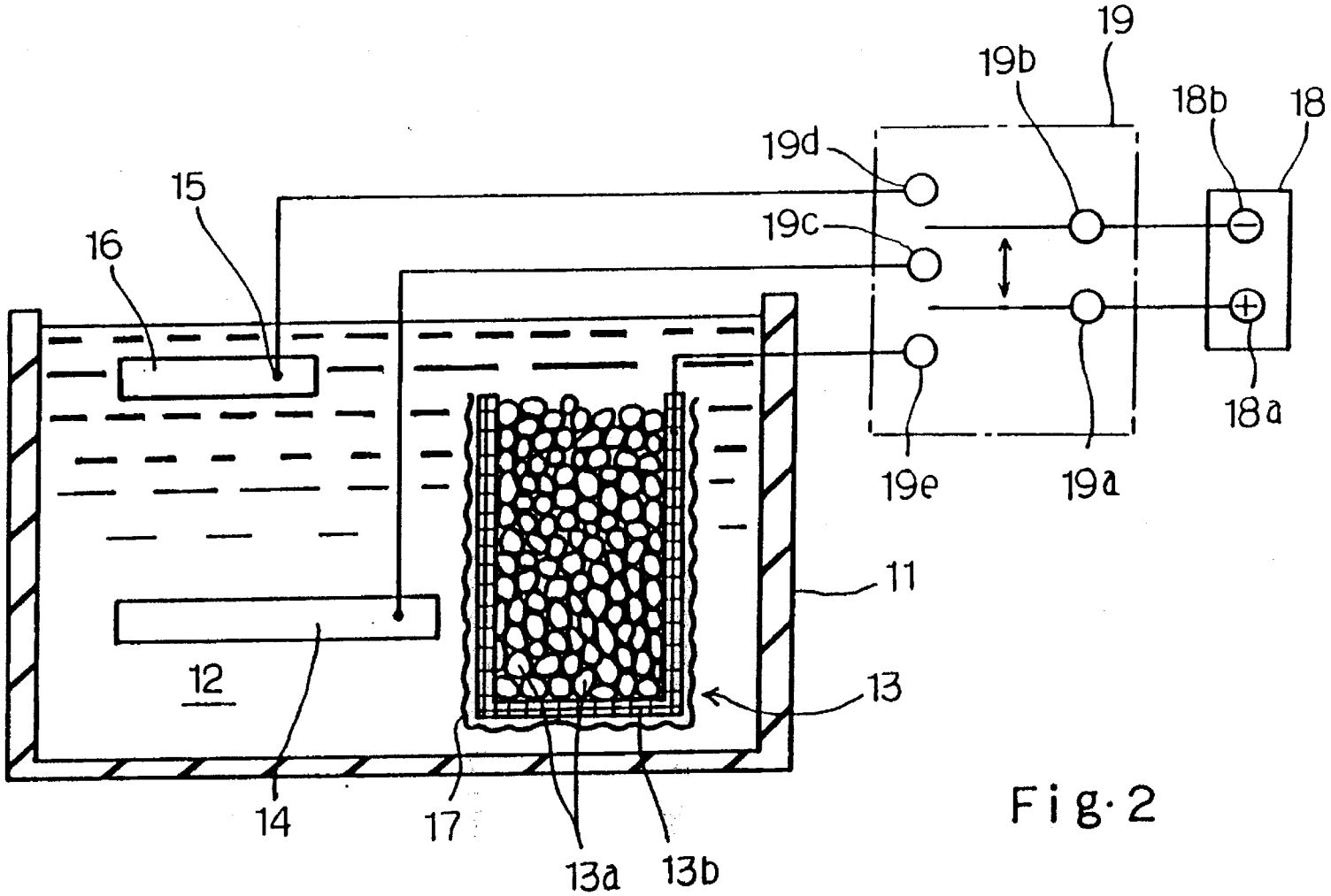
FIG. 2 is a cross sectional view showing an electroplating apparatus according to the present invention.

Referring to FIG. 2 of the drawings, an electroplating apparatus embodying the present invention comprises an electrolysis vessel 11 for electrolyte 12, a soluble anode 13 dipped in the holding electrolyte 12, an insoluble anode 14 also dipped in the electrolyte 12 and laterally spaced apart from the soluble anode 13 and a cathode 15 also dipped in the electrolyte 12 and positioned over the insoluble anode 14. The cathode 15 can retain a work 16, and keeps the work 16 in opposing relation to the insoluble anode 14 in the electrolyte 12. The shape and the position of the insoluble anode 14 affects the uniformity of a deposited metal film on the work 16, and are carefully determined.

In this instance, the insoluble anode 14 is formed of platinum or titanium coated with platinum, and the soluble anode 13 is, by way of example, implemented by granulated solder 13*a* filled in a conductive net 13*b* of, for example, titanium. The substance of the soluble anode 13 is changeable depending upon a metal film deposited on the work 16.

The conductive net 13*b* is enclosed in an anode bag 17 serving as a sludge filter, and the anode bag 17 is preferably formed of cloth. The anode bag 17 and the conductive net 13*b* can expose the granulated solder 13*a* to the electrolyte 12. However, the anode bag 17 prevents the electrolyte 12 from sludge produced from the granulated solder 13*a*.

The electroplating apparatus further comprises an electric power source 18 having a positive electrode 18*a* and a negative electrode 18*b*, and a switching unit 19 having two input ports 19*a* and 19*b*, respectively connected with the positive and negative electrodes 18*a* and 18*b*. The switching unit 19 has three output ports 19*c*, 19*d* and 19*e* respectively connected with the insoluble anode 14, the cathode 15 and the soluble anode 13. The switching unit 19 interconnects the input ports 19*a* and 19*b* and the output ports 19*c* and 19*d* or the input ports 19*a* and 19*b* and the output ports 19*e* and 19*d* depending upon the operational phase of the electroplating apparatus. In the illustrated embodiment, the electric power source 18 is implemented by a rectifier. However, a direct current source can be used for the electric power source 18.

Figure 3:
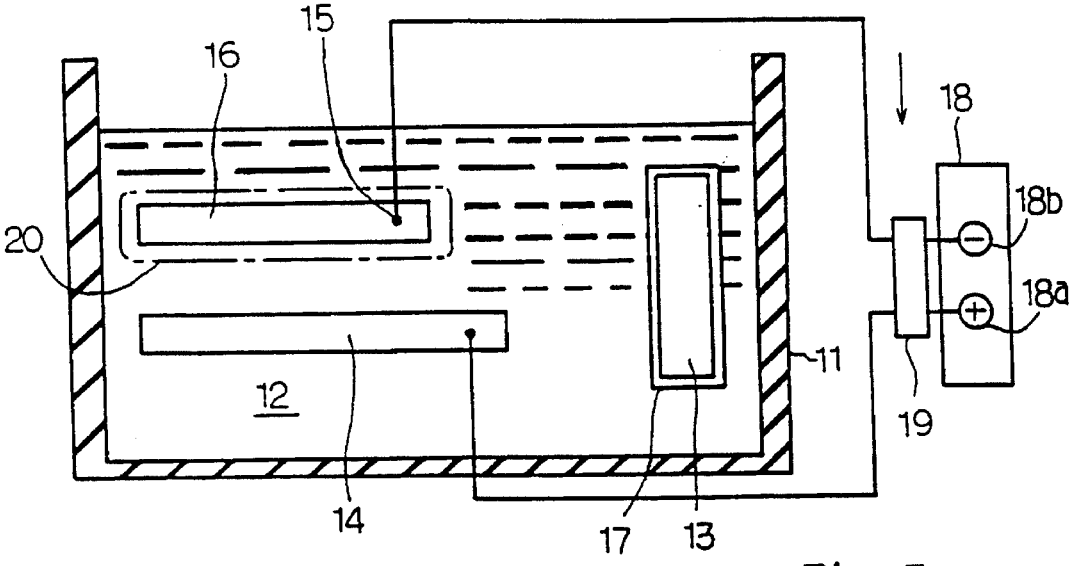
FIG. 3 is a cross sectional view showing the electroplating apparatus of FIG. 2 in a plating phase.

An electroplating sequence according to the present invention has a plating phase and a make-up phase. In the plating phase, the switching unit 19 connects the input ports 19*a* and 19*b* with the output ports 19*c* and 19*d* as shown in FIG. 3, and the insoluble anode 14 is positively biased with respect to the cathode 15 and, accordingly, to the work 16. Current flows through the electrolyte 12 between the insoluble anode 14 and the work 16, and an electrolytic reaction takes place in the electrolyte 12. As a result, the metal ion is deposited on the work 16, and the work 16 is coated with a metal film 20.

The insoluble anode 14 does not provide metal ions, and the ion concentration of the electrolyte 12 is decreased with time.

Figure 4:
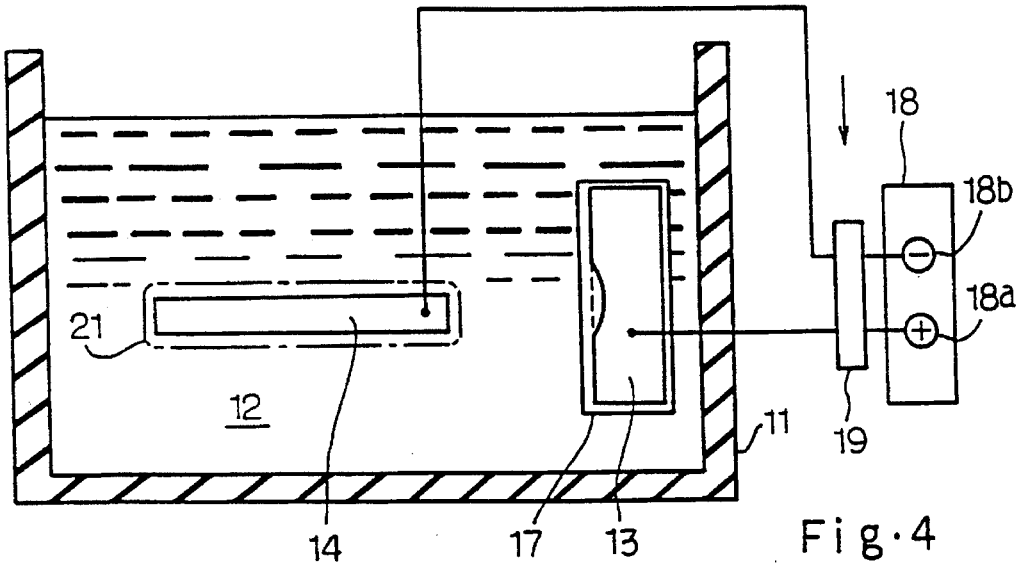
FIG. 4 is a cross sectional view showing the electroplating apparatus of FIG. 2 in a make-up phase.

When the ion concentration reaches a critical value, the electroplating apparatus enters into the make-up phase, and the switching unit 19 connects the input ports 19*a* and 19*b* with the output ports 19*e* and 19*d* as shown in FIG. 4. Then, the soluble anode 13 is positively biased with respect to the insoluble anode 14. Current flows through the electrolyte 12 between the soluble anode 13 and the insoluble anode ]4, and the soluble anode 13 supplies metal ions into the electrolyte 12. While supplying the metal ions, the anode bag 17 filters off sludge produced from the granulated solder 13*a*, and the metal ion is deionized at the insoluble anode 14. As a result, the metal 21 is deposited on the insoluble anode 14 without the sludge. Although the soluble anode 13 is consumed, the ion concentration of the electrolyte 12 is constant.

If the amount of electric charge flowing in the makeup phase is equal to the amount of electric charge flowing in the plating phase, the soluble anode 13 adds an amount of metal equal to the metal consumed in the plating phase. The amount of electric charge is equal to the product of the current and time.

After the make-up phase, the electroplating apparatus returns to the plating phase, and the electric power source 18 positively biases the insoluble anode 14 with respect to the work 16 again. The deposited metal 21 is ionized into the electrolyte 12, and a metal film 20 is deposited on the work without sludge. The ion concentration of the electrolyte 12 is maintained constant by ionizing the metal film 21, and the electroplating apparatus alternately repeats the make-up phase and the plating phase.

As will be appreciated from the foregoing description, the anode bag 17 allows the metal ion to be deposited on the insoluble anode without sludge, and keeps the quality of the metal film 20 deposited on the work 16 high. Moreover, the soluble anode 13 replaces the used metal ion, and the electroplating apparatus and the method of electroplating reconciles the high quality deposited metal film and the simple electroplating work.

Second Embodiment

Figure 5:
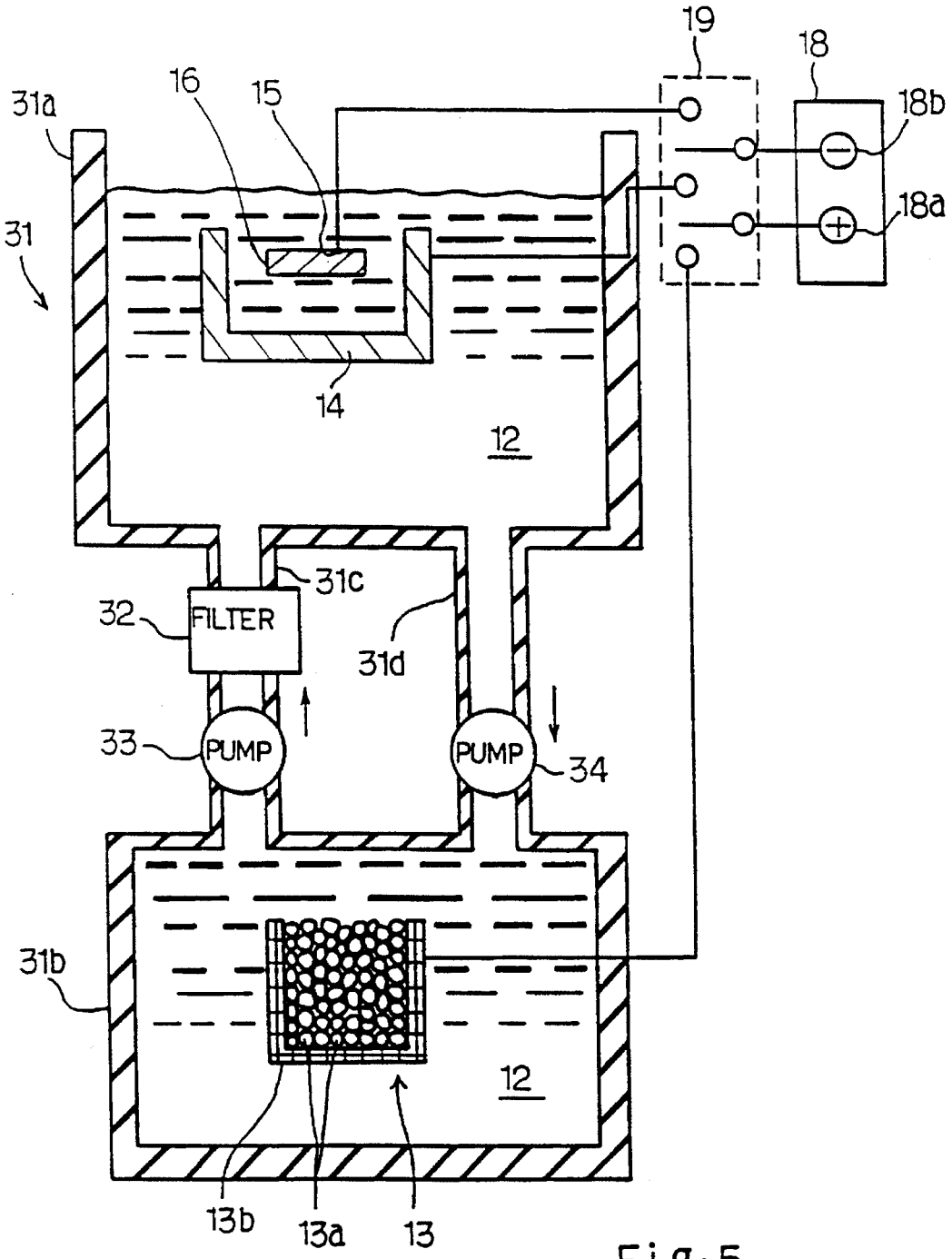
FIG. 5 is a cross sectional view showing another electroplating apparatus according to the present invention.

Turning to FIG. 5 of the drawings, another electroplating apparatus embodying the present invention is illustrated. An electrolyte, a soluble anode, an insoluble anode, a cathode, a work, an electric power source and a switching unit are similar to those of the first embodiment, and are labeled with the same reference numbers as the corresponding members and units without detailed description.

An electrolysis vessel 31 of the apparatus is implemented by two tanks 31*a* and 31*b* connected by conduits 31*c* and 31*d*. The insoluble anode 14 and the work 16 are located in the electrolyte 12 in the tank 31*a*, and the soluble anode 13 is located in the electrolyte 12 in the tank 31*b*.

A filter unit 32 and a pump unit 33 are inserted in the conduit 31*c*, and a pump unit 34 is provided in the conduit 31*d*. Since filter unit 32 filters off sludge produced from the soluble anode 13, the soluble anode 13 is not enclosed in an anode bag. The pump unit 33 forces the electrolyte 12 in the tank 31*b* to flow through the filter unit 32 into the tank 31*a*. On the other hand, the pump unit 34 forces the electrolyte 12 in the tank 31*a* to return to the tank 31*b*.

The electroplating apparatus thus arranged repeatedly enters into the plating phase and the make-up phase in a manner similar to the first embodiment, and deposits a metal film on the work 15 without sludge.

The electroplating apparatus implementing the second embodiment achieves all the advantages of the first embodiment. Moreover, the separated tanks 31*a* and 31*b* results in stability of electric field around the work 16. Particularly, if the electric field around the work 16 is unstable, the plating speed should be lowered in so far as the manufacturer keeps the quality of the deposited film high. If the two anodes, i.e., the soluble anode 13 and the insoluble anode 14, are in a single vessel, the electric field around the work 16 is likely to be disturbed. However, since the insoluble anode 14 and the soluble anode 13 are respectively provided in the tanks 31*a* and 31*b* in the second embodiment, and the sole insoluble anode 14 keeps the electric field around the work 16 stable. As a result, the plating speed can be increased ten times larger than that of the prior art without sacrifice of the quality.

Although particular embodiments of the present invention have been shown and described, it will be obvious to those skilled in the art that various changes and modifications may be made without departing from the spirit and scope of the present invention.

For example, the switching unit 18 may be responsive to a timer for changing the electroplating apparatus between the plating phase and the make-up phase, and a sensor may monitor the electrolyte for providing an appropriate timing to the switching unit 18. Moreover, any filter element is available for eliminating the sludge in so far as the filter element allows the electrolyte to pass therethrough. In the above described embodiment, current firstly flows between the insoluble anode and the work for the plating, thereafter, current flows between the soluble anode and the insoluble anode for supplement of the metal, and the plating and the supplement are repeated. However, current may firstly flow between the soluble anode and the insoluble anode, and the plating follows.

The apparatus and the method may be used in an electroplating of solder for a leadframe of a semiconductor device, and the apparatus plates high-purity solder on the leadframe at high-speed.

What is claimed is:

1. A method of electroplating comprising the steps of:

a) preparing an electrolysis vessel filled with an electrolyte containing an ionized substance, a soluble conductive member located in said electrolyte and containing a substance to be ionized, an insoluble conductive member spaced apart from said soluble conductive member in said electrolyte, and a cathode retaining a work in said electrolyte in spaced relation to said insoluble conductive member;

b) causing current to flow between said soluble conductive member and said insoluble conductive member for depositing said substance on said insoluble conductive member during a make-up phase of said method; and c) causing current to flow between said insoluble conductive member and said work for depositing said substance on said work.

2. The method as set forth in claim 1, in which a filter means is provided in association with said soluble conductive member for filtering off a sludge produced from said soluble conductive member during an ionization of said substance, said sludge being filtered by said filter means while said substance is being deposited on said insoluble conductive member.

* * * * *